US006886466B2

(12) United States Patent
Senules

(10) Patent No.: US 6,886,466 B2
(45) Date of Patent: May 3, 2005

(54) METHOD AND APPARATUS FOR SLEEVING A BOREHOLE

(76) Inventor: Jeffrey S. Senules, 1830 SE. 3rd Ct., Crystal River, FL (US) 34429

( * ) Notice: Subject to any disclaimer, the term of this patent is extended or adjusted under 35 U.S.C. 154(b) by 0 days.

(21) Appl. No.: 10/167,062

(22) Filed: Jun. 11, 2002

(65) Prior Publication Data

US 2003/0006044 A1 Jan. 9, 2003

Related U.S. Application Data

(60) Provisional application No. 60/297,361, filed on Jun. 11, 2001.

(51) Int. Cl.[7] ..... F42D 3/00; E21B 43/248

(52) U.S. Cl. ..... 102/313; 102/324; 102/331; 102/319; 166/262; 166/299; 166/63

(58) Field of Search ..... 166/63, 230, 252, 166/262, 278, 299, 378, 256; 299/13; 428/608; 139/425 R; 245/2; 102/313, 319, 323, 324, 331

(56) References Cited

U.S. PATENT DOCUMENTS 371,298 A * 10/1887 Bourne ..... 102/313
1,863,921 A 6/1932 McCloud
2,138,603 A * 11/1938 Johnson ..... 102/331
3,696,703 A 10/1972 Fox ..... 86/20 C
3,881,417 A 5/1975 Mesia ..... 102/22
4,019,438 A * 4/1977 Swanson, Jr. ..... 102/331
4,494,603 A * 1/1985 Harguindey ..... 166/230
4,572,075 A 2/1986 Day et al. ..... 102/313
5,192,819 A 3/1993 Baumgartner ..... 86/20.15

* cited by examiner

*Primary Examiner*—David Bagnell
*Assistant Examiner*—Matthew J. Smith
(74) *Attorney, Agent, or Firm*—Webb Ziesenheim Logsdon Orkin & Hanson, P.C.

(57) ABSTRACT

A novel method and device for sealing a borehole that is filled either partially or completely with water. A water-permeable sleeve is capable of expanding to the diameter of the borehole, and is constructed of a material that will allow the passage of water in and out throughout its length, with a series of apertures, but will prevent an explosive charge from escaping. Once the sleeve is in place, a hose, to introduce the explosive charge, is lowered through the sleeve to bottom of the borehole.

16 Claims, 1 Drawing Sheet

METHOD AND APPARATUS FOR SLEEVING A BOREHOLE

CROSS REFERENCE TO RELATED APPLICATION

This application claims the benefit under 35 U.S.C. § 119(e) of U.S. Provisional Patent Application Ser. No. 60/297,361, filed on Jun. 11, 2001, which is incorporated herein by reference in its entirety.

BACKGROUND OF THE INVENTION

1. Field of the Invention

This invention relates to methods and apparatus for sleeving a borehole that is partially or totally filled with water.

2. Description of the Prior Art

Pumpable explosives have been in use for many years. Although pumpable explosives are often used in dry boreholes, they are primarily applied in situations where high levels of ground water exist. In many mines, the presence of ground water is so great that it is virtually impossible to remove the water from a borehole. Pumpable explosives, then, are used in boreholes completely or at least partially filled with water. Typically, the explosives are pumped from the bottom of the borehole upward to the top. The water is displaced as the borehole is filled with the explosive.

Often a heavily water saturated geology will have voids, caverns, and fissures. This presents a problem when using pumpable explosives. The fluid nature of the explosive enables the pumpable explosive to migrate out from the borehole to the voids, caverns, or fissures. This results in a loss of explosive product, which is both wasteful and unsafe.

Previously, containment of the pumpable explosive was achieved by two methods. First, the product was prepackaged in a bag form and lowered into the borehole. Packaged products must be smaller than the diameter of the borehole, so less explosive can be placed into the borehole than when the explosive is directly pumped into the borehole. Moreover, the gap left between the package and the edge of the borehole causes the explosive charge to be less efficient due to poor compacting. The second previously known containment method involved casing the borehole with a rigid tube made of cardboard, PVC, or plastic. The explosives were then pumped inside the rigid casing. Again, this method did not offer the benefit of completely filling the borehole, and the rigid tube deflected and diminished the energy of the blast.

U.S. Pat. No. 3,696,703 discloses a blasting agent package that consists of a sleeve and concertina tubes. U.S. Pat. No. 4,572,075 discloses methods and apparatus for loading large drill holes with explosives, although not narrow boreholes exposed to large amounts of water. The technology in the '075 patent is intended for use in large diameter drill holes, using primarily non-pumpable explosives which are applied from the top of the drill hole to the bottom, whereas the present invention introduces pumpable explosives into narrow boreholes from the bottom to the top, with the narrow boreholes' being largely, if not completely, submerged under water. Also, in the '075 patent, the casing is a delivery mechanism for the explosive charges introduced at the top into drill holes where underwater challenges are not addressed, whereas in the present invention the sleeve is a containment means to retain pumpable explosive, introduced from the bottom, in the central core of a watery borehole plagued by fissures and crevices typical of underwater terrain.

Accordingly, a need remains for a way maximally to introduce explosives into a water-saturated borehole that is predictable and cost-effective, and which maximizes the explosive charge and avoids loss thereof.

SUMMARY OF THE INVENTION

In order to meet this need, the present invention discloses a novel method and device for sealing a borehole that is filled either partially or completely with water. More specifically, the present invention is a device which is able to expand under water and to seal a borehole, thus preventing the passage (or migration) of an explosive charge out from the borehole. The apparatus of the present invention is a water-permeable fabric sleeve that is capable of expanding to the diameter of the borehole. The sleeve is constructed of a material that will allow the passage of water in and out throughout its length, such as with a series of apertures, but will prevent an explosive charge from escaping. The sleeve when made of a woven fabric provides at least 70% coverage, that is, at least 70% of the sleeve surface is fabric, as opposed to apertures or interstices which allow passage of water, and the sleeve fabric, when woven, is at least 5 mil in thickness. The sleeve, when made of a nonwoven fabric, may have any effective thickness and percentage of coverage, that is, enough coverage to contain the pumpable explosive. A practical minimum for nonwoven fabrics is at least about 25%, more preferably at least about 50% coverage, and at least about 0.5 mil, more preferably, at least about 1 mil in thickness. The sleeve is constructed of such water-permeable fabric for the entire length of the borehole (or at least along the portion of the borehole which is filled with water). The sleeve is optimally more than five feet longer than the depth of the borehole. Preferably, the sleeve is lowered into the borehole by affixing the bottom of the sleeve to a rigid pole, or a series of rigid poles, which can be linked together. Each pole is then pushed to the bottom of the borehole, taking the sleeve along. After the sleeve is completely lowered to the bottom of the borehole, a weighted device ordinarily anchors the sleeve. Because the sleeve is readily permeable to water, any entrapped air escapes through the fabric during the descent. This reduces the possibility of the sleeve's floating as hydrostatic pressure increases. After the sleeve is in place, a hose used for the delivery of the explosive charge is lowered through the sleeve to the bottom of the borehole and the pumping of the explosive can begin.

DETAILED DESCRIPTION OF THE INVENTION

Figure 1:
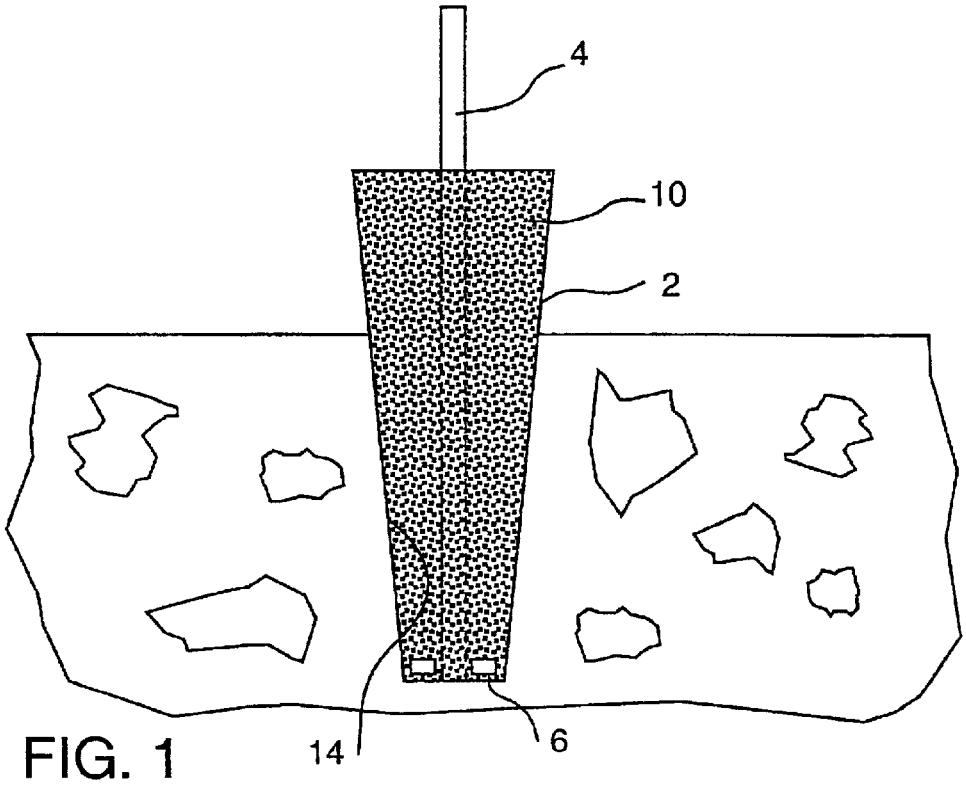
FIG. 1 is a sectional view of the preferred embodiment of the present invention placed within a borehole.

The present invention discloses a novel method and device for sealing a borehole that is filled either partially or completely with water. More specifically, the present invention is a device which is able to expand under water and to seal a borehole, thus preventing the passage (or migration) of an explosive charge out from the borehole. The apparatus of the present invention is a water-permeable fabric sleeve that is capable of expanding to the diameter of the borehole. The sleeve is constructed of a material that will allow the passage of water in and out throughout its length, such as with a series of apertures, but will prevent an explosive charge from escaping. When the sleeve is made of a woven fabric, the woven fabric provides at least 70% coverage, that is, at least 70% of the sleeve surface is fabric as opposed to apertures or interstices which allow passage of water, and the sleeve fabric, when woven, is at least 5 mil in thickness. Nonwoven sleeves may be of less than 70% coverage and any effective thickness as long as they are able to contain the pumpable explosive. The nonwoven sleeves may provide as little as about 25% coverage with fabrics a minimum of about 0.5 mil thick, although more preferably the nonwoven sleeves provide at least about 50% coverage with fabrics having thickness of at least about 1 mil. The sleeve is constructed of such water-permeable fabric for the entire length of the borehole (or at least along the portion of the borehole which is filled with water).

Any natural or synthetic material that is water permeable can be used to construct the sleeve. Examples include, but are not limited to: polyamides, cotton, polyesters, cellulosics, and cellulose acetates. Water porosity of the sleeve is achieved by a variety of means. Examples include, but are not limited to: multiple interstices generally evenly spaced throughout the sleeve's entirety, multiple interstices generally unevenly spaced throughout the sleeve's entirety, and interstices at strategically located positions throughout the sleeve. Preferably, the interstices are of a radius between 1 $\mu$m and 2 cm with 1–1000 interstices per square cm of surface area. The sleeve is optimally more than five feet longer than the depth of the borehole. Water permeability may be due to the woven nature of the fabric or may be other apertures, perforations, or interstices in the fabric. Sleeve construction itself may be performed in any fashion, including but not limited to, scam sewing, gluing, hot melt or sonic bonding of flat fabrics or weaving, or other fabrication of tubular seamless sleeves or semi-seamless sleeves.

Preferably, the sleeve is lowered into the borehole by affixing the bottom of the sleeve to a rigid pole, or a series of rigid poles, which can be linked together. Each pole is then pushed to the bottom of the borehole, taking the sleeve along. After the sleeve is completely lowered to the bottom of the borehole, a weighted device ordinarily anchors the sleeve. Because the sleeve is readily permeable to water, any entrapped air escapes through the fabric during the descent. This reduces the possibility of the sleeve's floating as hydrostatic pressure increases. Once the sleeve is in place, a hose used for the delivery of the explosive charge is lowered through the sleeve to the bottom of the borehole and the pumping of the explosive charge can begin.

This invention allows for containment of explosives while enabling the borehole to be completely loaded to the desired level. This invention is specifically designed to be used in boreholes where hydrostatic pressure exists due to the presence of water. It has long been a common practice to line boreholes with a plastic sleeve for the purpose of containing the explosive charge and/or preventing water from contacting the explosive charge. Previously, borehole sleeves were not capable of being used under water in the manner described herein secondary to hydrostatic pressure preventing the sleeve from opening properly.

This invention enables modern pumpable explosives to be used in situations that previously required different types of containment that were not as efficient. This invention is designed to contain a fluid explosive that could possibly escape from the borehole through fissures and voids in rock. This device is not intended to protect the explosive from the effects of the water which is encountered. This invention's sole use is to prevent the explosive from escaping from the borehole and, thus control the amount of explosive loaded into the borehole.

This invention applies predominantly only to the use of explosives which are designed to be used in water. The sleeve described herein must be made from a material which will allow for water to pass freely through while at the same time providing the necessary coverage. When constructed of a material which allows for the passage of water, the sleeve will effectively open under water even when high levels of hydrostatic pressure exist. Because this invention is used with explosives that are pumped from the bottom of the borehole upward, the sleeve will be forced open by the pumped explosives as they are introduced. As the sleeve is filled, it expands out against the edge of the borehole. The diameter of the sleeve is limited only by the diameter of the borehole. The important feature of the sleeve is that it is made of a material containing apertures of some sort which will allow water to pass, but not the explosive. By "aperture," it is meant any structure by which a fabric is rendered water permeable, including but not limited to, interstices due to weaving, interstices due to nonwoven fabrication, other interstices, pores, perforations, or other channels through the fabric which allow water to pass. It is also intended that the sleeve, after being pumped with explosives, be similar in diameter to the borehole.

The sleeve is intended for use as a containment device for pumpable explosives which are loaded underwater in a geology that is such that the explosives could escape the borehole through fissures, caverns, and voids. The sleeve is designed to be efficiently and reliably deployed under water even where high levels of hydrostatic pressure exist. The sleeve is also intended to expand to the diameter of the borehole as the explosive is pumped from the bottom of the borehole upward. The sleeve is designed to allow water to pass freely while containing the explosive charge. The free passage of water will enable the sleeve to reliably descend through water and allow the sleeve to open under hydrostatic pressure. The sleeve is not intended to protect the explosive from exposure to water. The sleeve is also not designed to serve as a delivery mechanism for the explosive charge. The sole purpose of the sleeve is to expand out against the edge of a borehole and contain an explosive charge which is pumped into the sleeve.

The invention is also intended to be applied in situations where borehole casings must be used to prevent the collapse of a borehole. A novel use of this invention is to use the sleeve in conjunction with a borehole casing.

As shown in FIG. 1, the expandable porous sleeve 2 is placed inside a borehole 14 prior to loading the explosive charge. Although FIG. 1 does not show the explosive charge itself within the sleeve 2, the explosive charge is a pumpable material which expands to fill the sleeve 2. The sleeve 2 is guided by a pole 4 or a series of poles 4 linked together. The bottom portion of the sleeve 2 is stabilized at the bottom of the borehole 14 by weight-bearing objects 6. Apertures 10, throughout the length of the sleeve 2, allow for free movement of water, causing full expansion of the sleeve 2 to the diameter of the borehole 14 after the explosive charge is introduced.

Figure 2:
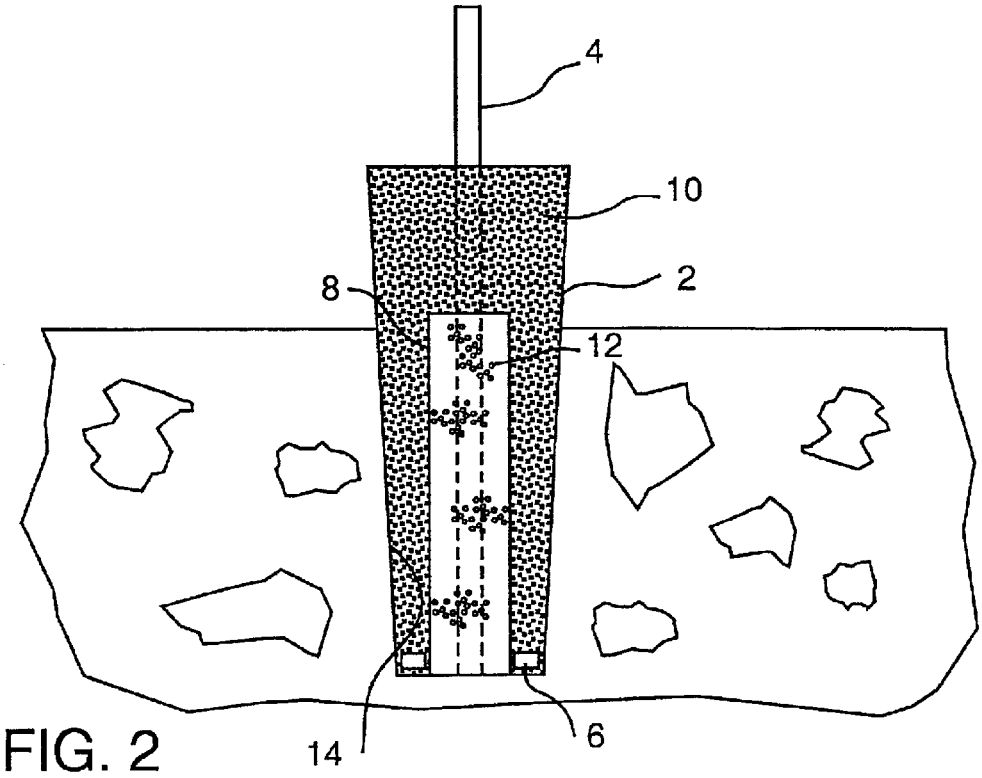
FIG. 2 is a sectional view of the present invention placed within a borehole.

As shown in FIG. 2, the expandable porous sleeve 2 can be placed on the outside of a rigid borehole casing 8. Although FIG. 2 does not show the explosive charge itself within the sleeve 2, the explosive charge is a pumpable material which expands to fill the sleeve 2. Again, a pole 4 or series of poles linked together may guide the sleeve 2 to the bottom of the borehole 14. However, when the rigid casing 8 is used the rigid casing 8 itself can in many cases be used (to guide the sleeve 2 down into the hole 14) instead of the poles 4. If the rigid borehole casing 8 has perforations 12, as shown in FIG. 2, this will allow the pumped explosive charge to exit the rigid borehole casing 8 and fill the sleeve 2, which is affixed to the outside of the rigid borehole casing 8. Apertures 10, throughout the length of the sleeve 2, allow for free movement of water. As the sleeve 2 is filled, it will expand to the diameter of the borehole 14. The benefit of this method is that the diameter of the explosive charge can be increased to the diameter of the borehole 14. In the previous art, the diameter of the explosive charge was limited to the diameter of the casing 8. By attaching the sleeve 2 to the outside of the rigid borehole casing 8, it is now possible to increase the diameter of the explosive charge in situations that require use of a rigid borehole casing 8. The use of this method has improved drastically the cost and performance of the explosive charge.

It is common practice to use a rigid borehole casing 8 in situations where the geology is such that the boreholes 14 will collapse after being drilled. Often, in sedimentary deposits of rock, only a small portion of the borehole 14 will collapse or close shut. Regardless of what percentage of the borehole 14 will close, it is often necessary to case the entire length of the borehole 14 so that it can be loaded with explosives.

There are many disadvantages that arise when casing 8 is needed. First, the casing 8 will have to be a smaller diameter than the borehole 14. Depending on the diameter of the borehole 14, the casing 8 can often be 68% smaller that the borehole 14. Consequently, a gap will exist between the inside edge of the borehole 14 and the outside edge of the explosive charge. The existence of a gap will result in what is referred to as decoupling the explosive charge. If an explosive charge is decoupled, a reduction in confinement will result. The strength and sensitivity of an explosive will be reduced as a result of a decrease in confinement and decoupling. Second, a specifically modified drill rig is required to drill a borehole 14 in which a casing 8 is used. Typically, these drills are limited as to the depth and diameter they can achieve. The present invention is beneficial when used in conjunction with a rigid borehole casing 8 because confinement of the explosive is obtained in a borehole 14 requiring a rigid borehole casing 8.

By placing the expandable porous sleeve 2 on the outside of the casing 8, decoupling of the explosive charge is prevented. Thus, the combination improves the performance of an explosive in a borehole 14. Additionally, the combination allows for an increase in the diameter of the explosive charge. An increase in diameter will increase the sensitivity and strength of an explosive charge. An explosive charge that is confined will be more effective than an explosive charge that is decoupled. The present invention offers a new and improved method and apparatus to increase the diameter of the charge and greatly improve the confinement of the charge. The combination of both improvements results in a significant improvement in explosive performance.

The present example describes a method for using the apparatus in a water-saturated borehole 14. The water-permeable fabric borehole sleeve 2 is flat prior to loading. Preferably, it is pre-assembled to a length that is at least five feet longer than the depth of the borehole 14 in which it will be placed. It is rolled in a manner that presents the bottom of the sleeve 2 first. The bottom section of the sleeve 2 is attached to a loading pole 4 of sufficient length to be pushed to the bottom of the borehole 14. In boreholes 14 greater than 20 feet in depth, a series of poles 4 are linked together in sequence as the poles 4 descend to the bottom of the borehole 14. The sleeve 2 is anchored to the bottom of the borehole 14 by placing a small amount of rock or other such weight-bearing objects 6 in the bottom of the sleeve 2 prior to loading. Because the sleeve 2 is made of a water-permeable material, it will tend to be neutrally buoyant, thus reducing the potential for the sleeve 2 to float. The sleeve 2 is affixed to a mechanism located above the borehole 14 which is made to straddle the borehole 14 and is located just above the surface. The purpose of the restraining mechanism is to prevent the sleeve 2 from being pulled below the surface of the ground. This prevents the weight of the explosive charge from dragging the sleeve 2 down into the borehole 14 during or after the explosive loading process.

After the sleeve 2 is in place, the borehole 14 is ready to be loaded with the explosive charge. A loading hose must be passed through the sleeve 2 to the bottom of the borehole 14. The sleeve 2 is uniquely designed so that is will efficiently and reliably open as the loading hose is lowered through the sleeve 2. The fundamental principle that enables the sleeve 2 to open is the fact that it is constructed of a water-permeable material throughout its length which allows for the free passage of water. This negates the effect of water pressure on the apparatus.

It is generally necessary for the explosive charge to be pumped from the bottom of the borehole 14 upward. The explosive charge is introduced after the loading hose has been lowered to the bottom of the apparatus, which is situated at the bottom of the borehole 14. Once the explosive charge is introduced, the apparatus will expand. The explosive charge will force water out through the porous fabric of which the apparatus is comprised. The apparatus will then expand outward to the very edge of the borehole 14.

This invention is unique in that it reliably and efficiently enables a water-filled borehole 14 to be sleeved so that the entire diameter of the borehole 14 can be filled with an explosive charge pumped into the borehole 14. Fundamental to the success of this invention is the use of a sleeve 2 that will allow the free passage of water for the entire length of the sleeve 2, which is under water.

It will be understood by those skilled in the art that while the foregoing description sets forth in detail preferred embodiments of the present invention, modifications, additions, and changes might be made thereto without departing from the spirit and scope of the invention.

Having thus described our invention with the detail and particularity required by the Patent Laws, what is desired to be protected by letters patent is set forth in the following claims.

What is claimed is:

1. An apparatus for sleeving a water-filled borehole comprising:

a water-permeable woven borehole sleeve having a first end and an open second end, said sleeve providing at least about 70% coverage but having apertures throughout, wherein said sleeve receives an explosive charge in a direction from the first end to the second end; and a structure selected from the group consisting of a rigid borehole casing or one or more poles, adapted to guide the placement of the sleeve in the borehole.

2. The apparatus for sleeving a water-filled borehole of claim 1, wherein the sleeve is at least about 5 mil in thickness and five or more feet longer than the depth of the borehole.

3. The apparatus for sleeving a water-filled borehole of claim 1, wherein said sleeve is capable of expanding to the diameter of the borehole.

4. The apparatus for sleeving a water-filled borehole of claim 1, wherein said sleeve is placed on the outside of said rigid borehole casing.

5. The apparatus for sleeving a water-filled borehole of claim 1, wherein said sleeve is further attached to a restraining mechanism located above the borehole surface.

6. An apparatus for sleeving a water-filled borehole, comprising:

a water-permeable nonwoven borehole sleeve having a first end and an open second end, said sleeve providing at least about 25% coverage but having apertures throughout; and a structure selected from the group consisting of a rigid casing or one or more poles, adapted to guide the placement of the sleeve in the borehole.

7. The apparatus for sleeving a water-filled borehole of claim 6, wherein the sleeve is at least about 0.5 mil in thickness and longer than the depth of the borehole.

8. A method for sleeving a water-filled borehole, comprising the steps of:

(a) attaching a first end of a water-permeable woven fabric borehole sleeve, providing at least about 70% coverage and having a thickness of at least about 5 mil to one or more poles or to a rigid casing;

(b) affixing a second end of the sleeve to a restraining mechanism located above the borehole surface;

(c) pushing the first sleeve end into the length of the borehole;

(d) placing a loading hose throughout the length of the sleeve to a bottom of the borehole; and (e) loading the sleeve with an explosive charge using the loading hose, causing expansion of the sleeve to a diameter of the borehole and displacement of an amount of water.

9. A method for sleeving a water-filled borehole according to claim 8, wherein said sleeve is flat prior to loading.

10. A method for sleeving a water-filled borehole according to claim 8, wherein said sleeve is capable of expanding to the diameter of the borehole.

11. A method for sleeving a water-filled borehole according to claim 8, wherein said sleeve envelopes a rigid borehole casing having perforations therein.

12. A method for sleeving a water-filled borehole, comprising the steps of:

(a) attaching a first end of a water-permeable nonwoven fabric borehole sleeve, providing at least about 25% coverage and having a thickness of at least about 0.5 mil to one or more poles or to a rigid casing;

(b) affixing a second end of the sleeve to a restraining mechanism located above the borehole surface;

(c) pushing the first sleeve end into the length of the borehole;

(d) placing a loading hose throughout the length of the sleeve to a bottom of the borehole; and (e) loading the sleeve with an explosive charge using the loading hose, causing expansion of the sleeve to a diameter of the borehole and displacement of an amount of water.

13. A method for sleeving a water-filled borehole according to claim 12, wherein said nonwoven fabric provides coverage of at least about 50% and has a thickness of at least about 1 mil.

14. An apparatus for sleeving a water-filled borehole comprising:

a water-permeable woven borehole sleeve having a first end and an open second end, said sleeve providing at least about 70% coverage but having apertures throughout, wherein the sleeve is at least about 5 mil in thickness and five or more feet longer than the depth of the borehole; and a structure selected from the group consisting of a rigid borehole casing or one or more poles, adapted to guide the placement of the sleeve in the borehole.

15. An apparatus for sleeving a water-filled borehole comprising:

a water-permeable woven borehole sleeve having a first end and an open second end, said sleeve providing at least about 70% coverage but having apertures throughout, wherein said sleeve is capable of expanding to the diameter of the borehole; and a structure selected from the group consisting of a rigid borehole casing or one or more poles, adapted to guide the placement of the sleeve in the borehole.

16. An apparatus for sleeving a water-filled borehole comprising:

a water-permeable woven borehole sleeve having a first end and an open second end, said sleeve providing at least about 70% coverage but having apertures throughout, wherein said sleeve is further attached to a restraining mechanism located above the borehole surface; and a structure selected from the group consisting of a rigid borehole casing or one or more poles, adapted to guide the placement of the sleeve in the borehole.

* * * * *